United States Patent [19]

George et al.

[11] 4,090,889

[45] May 23, 1978

[54] FORMING OF HIGH STRENGTH ALUMINUM ALLOY

[75] Inventors: Robert A. George, Detroit; John Pogorel, Jr., Lincoln Park, both of Mich.

[73] Assignee: Chrysler Corporation, Highland Park, Mich.

[21] Appl. No.: 741,255

[22] Filed: Nov. 12, 1976

[51] Int. Cl.[2] ..... C22F 1/04

[52] U.S. Cl. ..... 148/11.5 A; 148/12.7 A

[58] Field of Search ..... 148/11.5 A, 12.7 A, 148/159

[56] References Cited

U.S. PATENT DOCUMENTS

| | | | |
|---|---|---|---|
| 2,239,744 | 4/1941 | Smith et al. | 148/12.7 A |
| 3,172,787 | 3/1965 | Martenet | 148/12.7 A |
| 3,212,941 | 10/1965 | O'Brien | 148/12.7 A |
| 3,801,382 | 4/1974 | Ettenreich | 148/159 |

*Primary Examiner*—W. Stallard

*Attorney, Agent, or Firm*—Baldwin & Newtson

[57] ABSTRACT

A method of forming high strength aluminum alloys wherein ductility is increased only during forming and the resultant product exhibit minimal strength loss.

20 Claims, 6 Drawing Figures

FORMING OF HIGH STRENGTH ALUMINUM ALLOY

BACKGROUND

This invention relates to a method of forming high strength aluminum alloys, particularly in sheet form. The term "aluminum alloy(s)" as used herein refers to those aluminum alloys which have a "yield strength" (YS), after forming, of at least 25,000 psi. That is, the YS of alloys treated according to this invention may increase or decrease as a result of treatment but the final value will always be in excess of about 25,000 p.s.i. For the sake of convenience in laboratory testing, "hardness" ($R_B$) of the alloys tested and described herein was primarily used as a measuring parameter for test purposes. $R_B$ directly relates to YS and does not require the complicated procedures and handling necessary for making measurements as do YS determinations. The term "sheet" as used herein refers to a flat rolled product in coils or cut lengths having a thickness range of about 0.010 inches to about 0.250 inches in thickness. The term "high strength" in the sense used herein refers to aluminum alloys which obtain their high strength properties by heat treatment and/or by being cold worked into a tempered condition.

High strength aluminum alloys, particularly sheet, are desirable for use in automobiles manufactured because of their light weight and potential decorative appearance. For example, high strength aluminum alloy sheet provides decorative trim moldings which are more durable, have more resistance to denting, and are more resilient for snap-on attachment than comparable parts made of lower strength aluminum or aluminum alloys. However, high strength aluminum alloy sheet has the potential of being primarily useful for structural parts, such as bumpers, bumper reinforcements, body panels, brackets and the like.

Forming high strength aluminum alloy sheet by standard press forming at ambient temperatures, as has been the standard practice to-date, is difficult because of the relatively low ductility of these alloys. During the forming operation the alloys tend to tear and/or fracture.

One approach which has been used for obtaining high strength aluminum alloy parts has been to start with an annealed low strength aluminum alloy, cold form it to a desired shape and then heat treat it to provide a part having high strength. However, the heat treatment then adds complexities to the manufacturing process and increases the piece cost of such parts. Also, heat treating to achieve high strength requires the use of energy, electrical or gas, and it is desirable to minimize energy use where possible.

The object of this invention is to provide improved methods for forming high strength aluminum alloys, particularly in sheet form.

SUMMARY OF THE INVENTION

This invention in its most general form provides simple methods of forming high strength aluminum alloys, as distinguished from lower strength annealed aluminum alloys, wherein a high strength aluminum alloy is heated to a predetermined minimal temperature below the recrystallization temperature of the alloy and the alloy is then formed into a desired shape while it is at or substantially at the heated minimal temperature.

The predetermined temperature for most high strength aluminum alloys has been found to be between about 200° F. and 600° F.

This invention has two major preferred embodiments.

In the first embodiment, using aluminum with an initial maximum high strength, e.g., a cold rolled or fully aged alloy, the high strength aluminum part is formed after having been heated to a predetermined minimal temperature and held at temperature for less than a predetermined minimum length of time, both of which are specific for the particular alloy involved. This reduces the strength loss due to heating the metal. When strength loss is minimized the formed part does not require heat treating subsequent to forming. Part complexity may require use of slightly higher temperatures in any given instance and consequently time at temperature may be shortened.

In the second embodiment, an alloy that has been solution heat treated but not aged to its maximum strength is used. In this partially heat treated condition the modest amount of heat used to improve formability also increases the metals strength by artificially aging the material due to the temperature to which the metal is heated during forming. In this circumstance the forming operation does not have to be performed as rapidly as possible because the initial strength loss with increasing temperature is not permanent and a low recovery or caging effect occurs in such alloys as is demonstrated in FIGS. 5 and 6. There are however optimum time-temperature relationships which are generally less stringent for this embodiment than for the embodiment first described above.

A primary distinguishing characteristic between the two embodiments resides in the nature of the alloy which is used in each. In the first method the alloy used is initially fully strengthened, as by working or solution heat treating and aging, etc. In the second method the alloy used is initially only a partially strengthened alloy such as one which has been solution heat treated only. Also, in the first embodiment, time at temperature should be short as reasonably possible. Thus, forming should take place as soon as possible after heating.

BRIEF DESCRIPTION OF THE DRAWING

FIGS. 5 and 6 additionally include the aging effect which occurs after forming a partially strengthened alloy.

DESCRIPTION OF THE PREFERRED EMBODIMENTS

Figure 1:
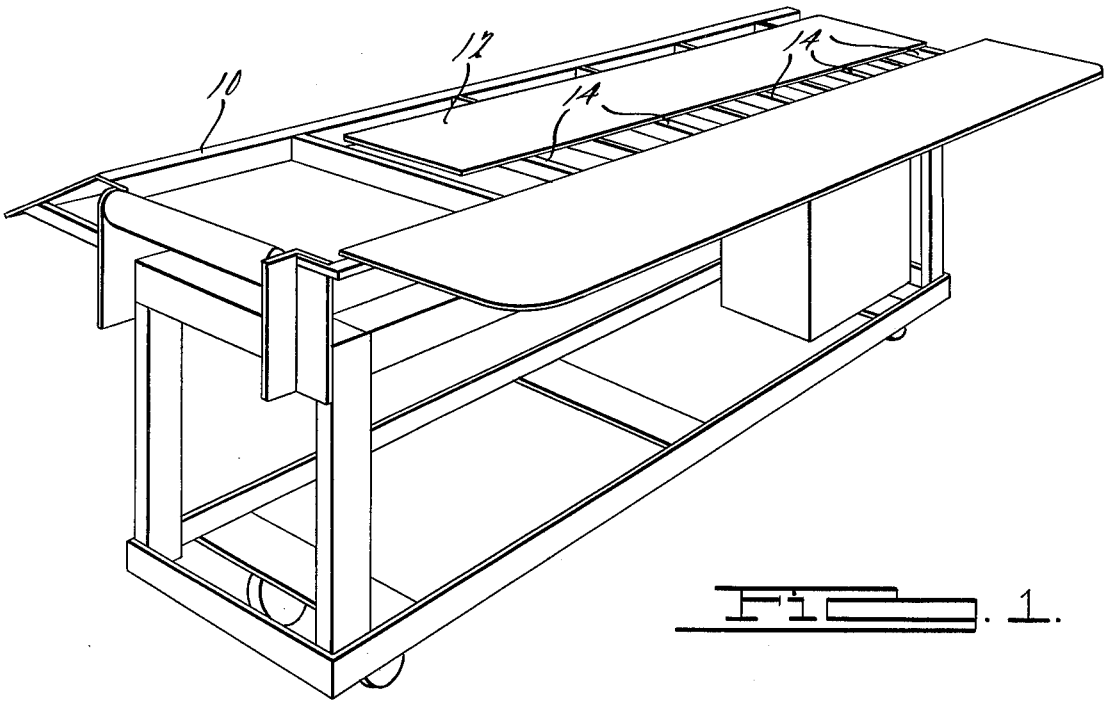
FIG. 1 is a schematic drawing of an infrared generator which is the preferred heating means used with the methods of this invention.

The forming methods of the invention are made possible by the large increase in formability with minimal strength loss which high strength aluminum alloys exhibit with modest heating. For example, the aluminum alloy 5252 (Aluminum Association designation) exhibits 4% elongation at room temperature and 50% elongation at 550° F. According to the invention, improved formability with minimum strength loss is possible if the forming of such high strength aluminum alloys is accomplished while the alloy is at a moderately elevated temperature, but below the recrystallization temperature of the alloy, within a predetermined time duration. The stratagem of this invention lies in taking advantage of the formability of these alloys with increasing temperature without substantially affecting their high strength.

From the standpoint of decorative trim, the forming of aluminum alloy 5252 demonstrates an embodiment of the inventive method with some of the high strength alloys. The aluminum alloy 5252 was tested in four tempers H281, H291, H25 and H24 (Aluminum Association designation) from three commercial sources, Kaiser Aluminum Co., Alcan Aluminum Corp. and Reynolds Metals Co., respectively. Initially, the Hille Wallace Universal Cup Tester was used for basic testing. Cupping tests were performed on samples of the 5252-H25 aluminum alloy. At 500° F. however, blanks up to 4-¾ inches were drawn without fracture. These workpieces did not exhibit any measurable loss of strength.

Detailed testing was performed on the forming of samples of the 5252-H281 alloy into wheel house moldings which are a typical example of automobile decorative trim. All samples (0.030 inch to 0.040 inch thickness) were roll formed to provide an arcuate molding of generally L-shaped cross-section. The roll formed sections were then clamped in a holding fixture and resistance heated to a moderate 450° F. forming temperature in accordance with the invention using a transformer with clamps similar to those employed in welding. The heated sections were then stretch formed over a mandrel. This technique includes simultaneously stretching and bending the molding over the mandrel.

All of the test samples formed easily at a temperature of 450° F. Table 1 presents the various data of interest for these tests by sample number.

TABLE I

| Sample | | Temper | Temperature Formed ° F. | Wheelhouse Opening Mouldings Aluminum 5252 R15T Hardness | Yield psi. | Ult. psi. | Elong. (%) | Evidence of Recrystallization | Condition |
|---|---|---|---|---|---|---|---|---|---|
| 1 | K | 28 | 80 | 80 | 35,900 | 43,100 | 7 | No | RF only |
| 2 | K | 28 | 80 | 77.5 | 38,300 | 43,600 | 6 | No | Fractured |
| 3 | K | 28 | 450 | 78 | 36,000 | 41,400 | 6 | No | OK |
| 4 | K | 28 | 500 | 76.5 | 35,000 | 40,000 | 8 | No | OK |
| 5 | K | 28 | 550 | 74 | 33,000 | 40,000 | 8 | No | OK |
| 6 | K | 28 | 550+ | 76.5 | 31,200 | 39,300 | 8 | No | Fractured Due to Mechanical interference |
| 7 | K | 29 | 80 | 81.5 | 40,300 | 45,300 | 5 | No | RF only |
| 8 | K | 29 | 80 | 79.5 | 40,800 | 45,100 | 5 | No | Fracture |
| 9 | K | 29 | 450 | 77 | 36,200 | 41,600 | 6 | No | OK |
| 10 | K | 25 | 80 | 77 | 32,000 | 39,300 | 9 | No | RF only |
| 11 | K | 25 | 80 | 75.5 | 33,900 | 39,100 | NA | No | Bent |
| 12 | K | 25 | 450 | 72.5 | 30,600 | 38,200 | 8 | No | OK |
| 13 | A | 24 | 80 | 73.5 | 27,000 | 34,600 | 10 | No | RF only |
| 14 | A | 24 | 80 | 73.5 | 29,100 | 34,800 | 9 | No | Fracture |
| 15 | A | 24 | 450 | 70 | 26,400 | 33,900 | 10 | No | OK |
| 16 | R | 25 | 80 | 70 | 25,200 | 33,000 | 11 | Yes | RF only |
| 17 | R | 25 | 80 | 69 | 27,300 | 33,500 | NA | Yes | OK |
| 18 | R | 25 | 450 | 68.5 | 25,100 | 32,200 | NA | Yes | OK |

All properties are at ambient temperature after forming at listed temperatures
RF = Rolled Formed only
NA = Fractured out of gauge length and % elongated could not be determined.
K = Kaiser Aluminum Co.
A = Alcan Aluminum Corp.
R = Reynolds Metals Co.

Samples 3, 4 and 5 were formed successfully at temperatures of 450°, 500° and 550° F., respectively. Sample 6 failed due to mechanical interference which was corrected before testing continued. Sample 17 was roll formed only to show cross section as roll-formed. Sample 8, which fractured, was an unsuccessful try at ambient temperature stretch forming. Sample 9 formed easily at 450° F. Sample 17, was the only sample tested which formed at ambient temperature. The 5252-H25 aluminum used for Sample 17 was found to be from 3.5 to 11.5 Rockwell 15T points softer than the others. This, along with evidence of recrystallization in the grain structure appears to be the reason for the increased ductility. Note that the hardness and tensile strength of samples 16, 17 and 18 are lower than the others. Photomicrographs of each sample were made and only in samples 16, 17 and 18 were there any evidence of recrystallization indicating that control must be exercised over the upper limits of the heating temperatures or strength loss results. Thus, only modest or moderate heating temperatures can be used in avoiding deleterious effects on metal strength prior to the forming step.

These tests show that hard-to-form high strength alloys can be contoured with warm forming into shapes without strength degradation which would not be possible otherwise in so simple a manner. With properly controlled temperatures and time cycles, deleterious effects on the metal are minimal. Also, warm forming does not affect anodized brightness. Heating cycles for this particular part and alloy were optimized to a maximum of 550° F. and times at temperature of about 60 seconds. Recrystallization as noted above is avoided by following the methods described herein.

The invention has particular application to the forming of high strength aluminum alloy sheet. In this connection it has been found that the heating necessary for forming sheet which is to be stamped is best accomplished from a practical standpoint in a production environment by means of infrared heating.

A suitable apparatus for the infrared heating of sheet is shown in FIG. 1. It is known as an infrared heat generator and is preferably portable so it can be easily positioned near any forming press which is to be used for stamping parts from the heated sheet. The infrared generator basically comprises a frame 10 on which the sheet 12 to be heated is supported over a source of infrared radiation. In this case, a plurality of infrared sources 14 are arranged below the sheet to heat it. Preferred IR sources currently being used are the gas fired types such as those commercially available from Van Dorn Company of Cleveland, Ohio as model No. C-1995 HDS. These IR generators use a metallic grid heated by a combustible gas mixture. The sheet shown is 0.150 inch × 12 inch × 60 inch and is representative of the stock which was tested in forming aluminum bumper reinforcements from alloys 5182-H140 and 7045-T63. The "as received" YS for some samples of these high strength alloys is shown in Table II below.

TABLE II

| Alloy | Sample # | Yield Strength (as received) | Forming Temp | Yield Strength (after forming) psi | Min. Temp. to Form Part ° F | Condition |
|---|---|---|---|---|---|---|
| 5182-H140 | 1 | 40,500 | 500 | | | Part formed |
| 5182-H140 | 2 | 40,500 | 400 | | | Part formed |
| 5182-H140 | 3 | 40,500 | 300 | | | Part formed |
| 5182-H140 | 4 | 40,500 | 200 | 38,000 | 200 | Part formed |
| 5182-H140 | 5 | 40,500 | Room Temp. | N/A | | Small Splits |
| 5182-H140 | 6 | 40,500 | Room Temp - No Lube | N/A | | Large Splits |
| 7046-T63 | 7 | 47,400 | 250 | 46,700 | 300 | All parts Formed |
| 7046-T63 | 8 | 47,400 | 250 | N/A | | Small splits |
| 7046-T63 | 9 | 47,400 | 200 | N/A | | Large splits |
| 7046-T63 | 10 | 47,400 | Room Temp. | N/A | | Many/Avg. Splits |

Time to reach temperatures
300° F 1–2 minutes
500° F 3–4 minutes

Table II also describes details concerning samples of the alloys which were formed according to the invention to provide bumper reinforcements. In stamping the sheet, a drawing lubricant such as H. A. Montgomery product MB-503 (a hard resin bonded graphitic coating) was used. The lubricant was placed on both sides of the blank sheet prior to heating. The blank was then heated by placing it on the infrared generator as shown in FIG. 1. The warmed blank was then formed by stamping in the ordinary way.

The heat-up rate of sheet using infrared heating is highly dependent on the surface conditions of the sheet. Besides being a satisfactory drawing lubricant, the MB-503 is black in appearance. An aluminum mill finish reflects about 95% of the infrared heat while aluminum sheet coated with an infrared absorbing or heat absorbing coating, such as black or a dark coating, will reflect only about 5% of the infrared. Thus, when aluminum sheet is coated, as with MB 503, the time to reach forming temperature is greatly reduced when using an IR heat source.

Referring now specifically to the test data in Table II, it can be seen that forming provided successful parts with each alloy. The final strength of the formed part varied as can be determined by comparing "as received" YS with the YS "after forming". The degree of strength loss depends on the alloy used the time at temperature and the maximum temperature to which the part was heated for forming. The degree of formability can be optimized for any given alloy part combination by adjusting the method to an optimum temperature for the particular alloy part.

From a practical standpoint, for most aluminum alloy parts the most useful temperature range for forming according to this invention is between about 200°–600° F. and the time at temperature is between about 1–30 minutes, 1–5 minutes being even more preferred.

GENERAL CONSIDERATIONS

The concept of heating to a predetermined temperature which is minimally high enough to allow the part to be made without tears, fractures or the like but which is below the recrystallization temperature for the high strength aluminum alloy to be formed is critical to the methods of this invention. In the case of fully aged and cold worked aluminum alloys, the time held at the heated temperature must also be considered. In general, the longer a high strength aluminum alloy is exposed to elevated temperature, e.g., in the 200°–600° F. range, the greater its strength loss will be. These parameters can be determined for any alloy by preparing a graph of the kind shown in FIGS. 2–6. In these graphs, hardness ($R_B$) (relatable to YS is plotted) v. time at a selected temperature for a given alloy. The graphs show the effects of time at a given selected temperature for any given alloy will show the optimum temperature range and time to be used for the alloy in heating it prior to forming it. Thus, an optimum time and temperature can be predetermined for any given alloy in order to form it without any permanent substantial strength loss and without splits, fractures or the like.

Figure 5:
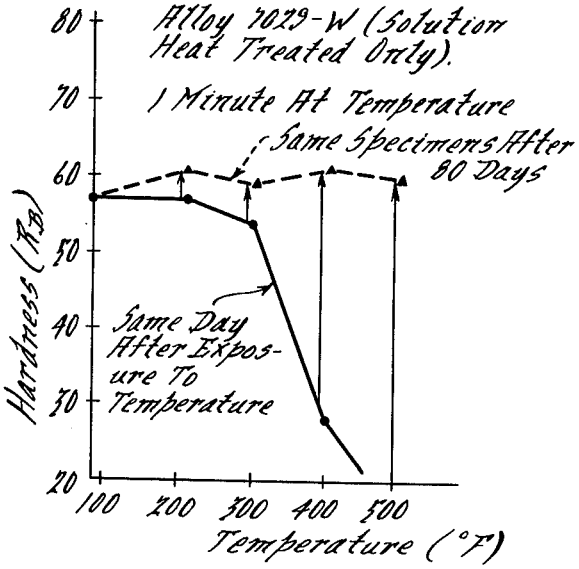
Figure 6:
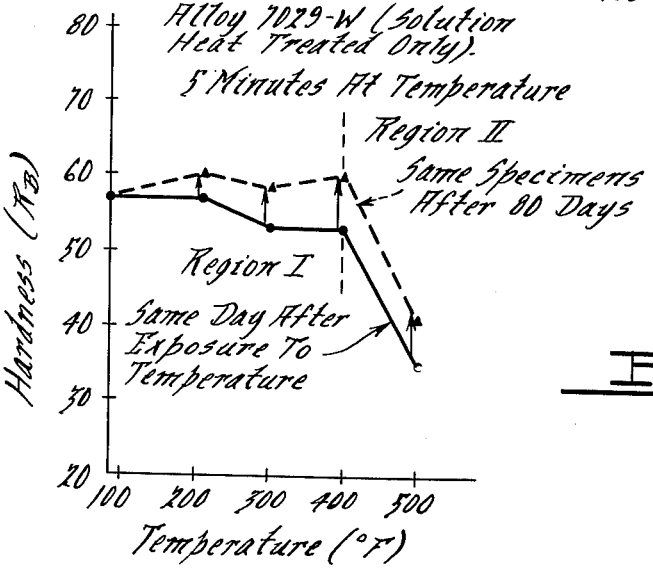

More specifically, it can be seen from FIGS. 2–4 and 6 that there are generally two regions I and II in such graphs. Region II is not shown in FIG. 5 because the time-temperature conditions were inadequate to cause the permanent loss in $R_B$ to show up on the graph. In the other graphs however, it can be seen that Region I is generally a plateau area which is more or less flat. Region II is a region of rapid drop in strength after the plateau of Region I. In FIGS. 5 and 6, the permanent hardness values are shown by the dotted lines. The change in hardness indicated by the solid lines in these Figures is only temporary. Recovery occurs as is indicated on the Figures. It is critical to these methods that the metal not be heated too high. The part must be formed before the time-temperature conditions of Region II are reached or a substantial loss of strength will occur in the alloy. The relative positions of Regions I and II, i.e., the characteristic time-temperature conditions, will vary depending on the particular alloy involved.

Figure 2:
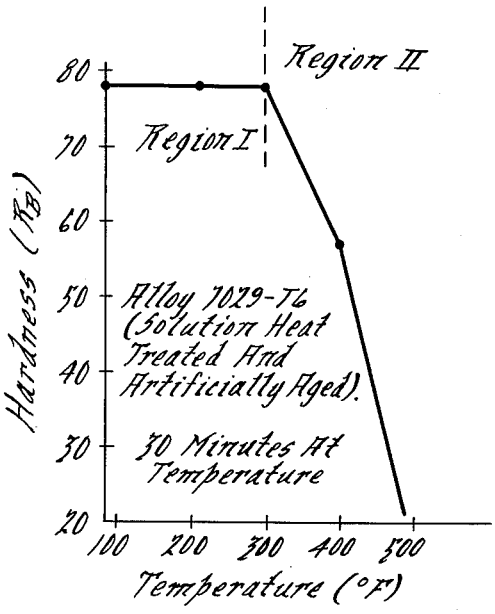
FIGS. 2–6 are graphs illustrating concepts of this invention. Each graph shows the effect of time and temperature on the strength of high strength aluminum sheet, using hardness ($R_B$) at various temperatures as an indicator of strength, for several test specimens exposed at various temperatures for equal times as noted for each curve plotted thereon.

Based on sample tests of alloy 7029-T6 as in FIG. 2 but at various times, it was determined that for this particular alloy and the particular part configuration involved, the optimum conditions for forming comprised heating to a temperature between about 200°–300° F. and forming within about 30 minutes after reaching the heating temperature. This provided a part without substantially affecting the high strength characteristics of the alloy.

Figure 3:
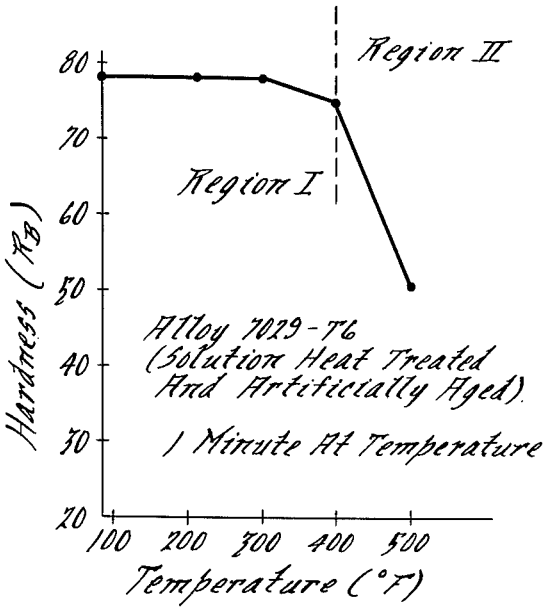

Similarly, the same part and alloy combination could be formed as in FIG. 3 by heating to a temperature between about 200°–400° F. but the part must be formed very quickly i.e., within 1 minute of being at temperature. This is not considered optimum as the time is short for normal handling procedures.

Figure 4:
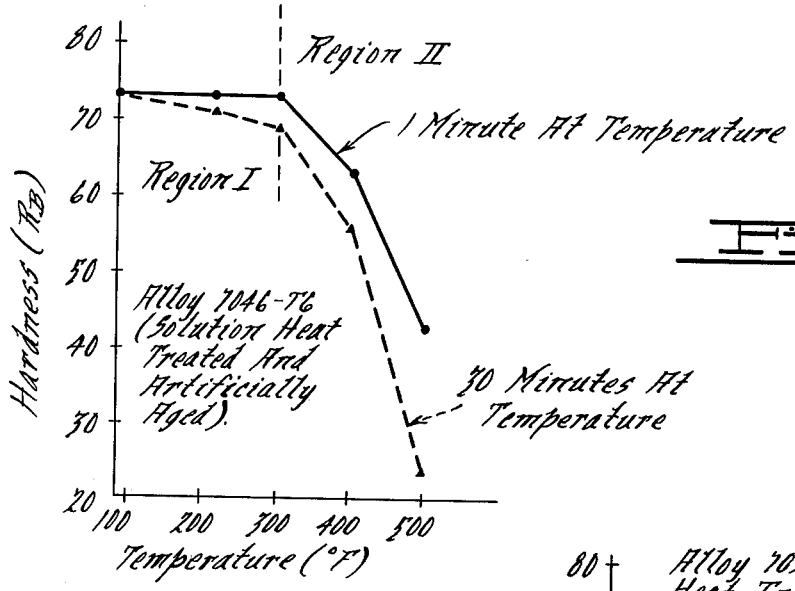

FIG. 4 shows a third alloy-part combination example in which time at temperature is important. A 30-minute curve and a one minute curve are both plotted for the 7046-T6 alloy. In this case, if the part can be quickly formed, i.e., within 1 minute of reaching the desired heating temperature, it can be heated to a temperature between 200°–300° F. Otherwise, the 30 minute curve shows the loss in hardness.

Because of the nature of the alloy described in FIGS. 5 and 6, i.e., not fully strengthened, time at heated temperature is not critical since the part recovers its strength loss as indicated in the graphs. Both figures deal with a 7029-W alloy. In FIG. 5, the sample specimens were held at the temperatures indicated for one minute whereas in FIG. 6 the sample specimens were held for 5 minutes. This Figure demonstrates that the part involved may be heated between about 300°–400° F. and held there for five minutes for forming without substantially affecting the permanent strength (dotted line) of the alloy.

It has been determined that a desirable practice for any given part and alloy combination is to form samples of the part at successively high temperatures starting at a low temperature until a minimal temperature in Region I is reached at which the part can be soundly formed without tears or fractures. If consonant with good tool life, that temperature is the one which should be used. Slight adjustments can be made to accommodate handling time and part complexity if they are factors.

Also, from the cost standpoint, the first embodiment of the invention is preferred in that the starting material selected can be a coldworked alloy which has not had any heat treatment and is therefore lower in cost. It is only necessary in this method that consideration be given to forming the part in the shortest possible time after it is heated to the desired temperature. The use of the on-site IR heating apparatus described above is particularly desirable in this embodiment because of its rapid heating and close convenience to the forming tool.

What is claimed is:

1. The method of forming a high strength aluminum alloy part without substantial loss of alloy strength, comprising the steps:

heating the alloy to an elevated temperature below that at which an initial substantial strength loss will occur and below the alloy recrystallization temperature, maintaining the alloy at the elevated temperature range for a time less than the time at which any substantial loss of strength occurs, and forming the alloy into the part while it is in the heated condition.

2. The method of claim 1 in which the temperature is between about 200° and 600° F.

3. The method of claim 2 in which the aluminum alloy is fully strengthened initially.

4. The method of claim 2 in which the aluminum alloy is partially strengthened initially and the time at temperature is limited to less than about 30 minutes.

5. The method of claim 1 in which the time for maintaining the alloy at the temperature range is about 1 to about 30 minutes.

6. The method of claim 4 in which the time is about 1 to about 5 minutes.

7. The method of claim 1 in which the alloy has an initial yield strength of at least about 25,000 psi.

8. The method of claim 1 in which the alloy is in sheet form and the heating is accomplished by electrical resistance heating.

9. The method of claim 1 in which the alloy is in sheet form and forming is accomplished by stretch forming on a mandrel.

10. The method of claim 1 in which the heating is accomplished by exposing the alloy to a source of infrared radiation.

11. The method of claim 1 in which the alloy is in sheet form.

12. The method of claim 9 in which the sheet is coated at least on the surface to be exposed to the infrared heating source with an infrared absorbing coating.

13. The method of claim 12 in which the coating also acts as a lubricant for the subsequent forming operation.

14. The method of claim 12 in which the sheet is formed by stamping.

15. The method of claim 1 wherein the alloy used is initially in a partially heat treated condition.

16. The method of claim 1 wherein the alloy used is initially in the solution heat treated condition but not aged to its maximum strength.

17. The method of forming a part from a fully strengthened aluminum alloy without a substantial loss in the strength thereof due to forming, comprising the steps:

heating the alloy to a predetermined temperature which is high enough to allow forming of the part without tears and fractures and which is below the recrystallization temperature of the alloy, and forming the part substantially immediately when the alloy has reached the predetermined temperature, consonant with acceptable handling procedures.

18. The method of claim 16 wherein the alloy is a cold worked alloy.

19. The method of claim 16 wherein the alloy is a fully aged alloy.

20. The method of claim 16 wherein the alloy is initially in sheet form.

* * * * *